US005271809A

United States Patent [19]

Holzhausen

[11] Patent Number: 5,271,809

[45] Date of Patent: Dec. 21, 1993

[54] PYROLYTIC FURNACE FOR THE THERMAL CRACKING OF HYDROCARBONS

[75] Inventor: Hans-Joachim Holzhausen, München, Fed. Rep. of Germany

[73] Assignee: Selas-Kirchner GmbH, Höllriegelskreuth, Fed. Rep. of Germany

[21] Appl. No.: 935,780

[22] Filed: Aug. 28, 1992

[30] Foreign Application Priority Data

Aug. 28, 1991 [DE] Fed. Rep. of Germany ..... 4128521

[51] Int. Cl.[5] ..... C10G 9/20

[52] U.S. Cl. ..... 196/110; 122/235.23; 165/169; 196/116; 422/197; 422/204

[58] Field of Search ..... 422/197, 204; 165/169; 122/235.11, 235.15, 235.23; 208/132, 125; 585/648; 196/110, 116

[56] References Cited

U.S. PATENT DOCUMENTS

| | | | |
|---|---|---|---|
| 1,961,233 | 6/1934 | Mayr | 122/235.23 X |
| 3,237,610 | 3/1966 | von Wiesenthal et al. | 122/240 |
| 3,407,789 | 10/1968 | Hallee et al. | 122/356 |
| 4,160,701 | 7/1979 | Dorner et al. | 196/116 |
| 5,151,158 | 9/1992 | Bowen et al. | 422/204 X |

FOREIGN PATENT DOCUMENTS 3701214 8/1987 Fed. Rep. of Germany .

OTHER PUBLICATIONS

WO 90/12851, Published 01 Nov. 1990, on International Application No. PCT/FR90/00272, filed 13 Apr. 1990 of Procedes Petroliers et Petrochimiques for "Process and Apparatus for Decoking a Steam-Craking Installation".

European Search Report for EP 92 11 3909, dated 29 Sep. 1992, 2 pages.

*Primary Examiner*—Robert J. Warden
*Assistant Examiner*—Amalia L. Santiago
*Attorney, Agent, or Firm*—Millen, White, Zelano, & Branigan

[57] ABSTRACT

In a pyrolytic furnace for the thermal cracking of hydrocarbons, cracking tubes are combined into uniformly arranged groups in the radiation zone of the pyrolytic furnace. The cracking tubes in the radiation zone consist of straight, vertically extending tube sections, manifold tube sections, and tube elbows. The cracking tubes of one group are joined, in the throughflow direction, via manifold tube sections and terminate in an outlet tube. The cracking tubes are arranged in the radiation zone in one plane, except for the juts of the tube elbows. The straight tube sections, subjected to a throughflow from the bottom toward the top and combined in the outlet tube, are located between the straight tube sections subjected to a throughflow from the top toward the bottom and leading into the tube elbows. The curvatures of respectively one-half of the tube elbows of one group extend in the same direction, the direction of curvature of the halves of the tube elbows being in opposition. Prior to entering the radiation zone, the cracking tubes can be extended in one step (two 90° curvatures) about cracked gas coolers arranged above the outlet tubes. In this way, an especially advantageous vertical arrangement of the cracked gas coolers is made possible.

5 Claims, 2 Drawing Sheets

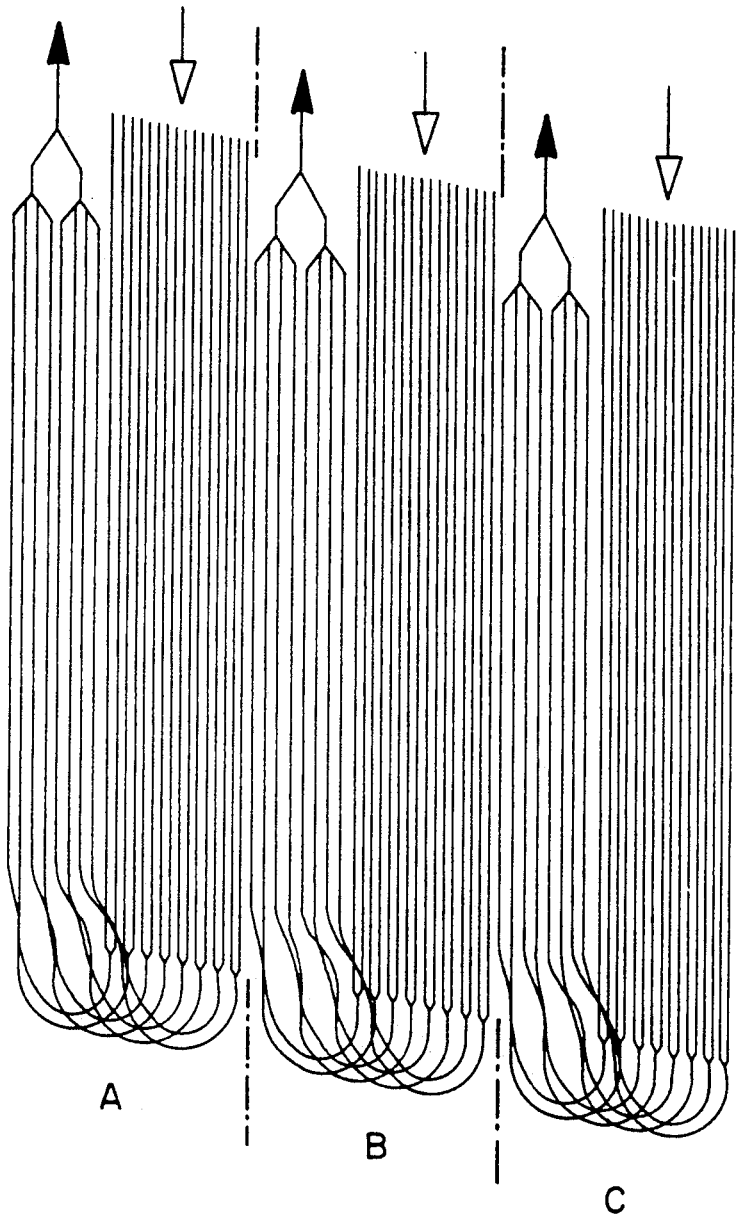
FIG. 1
PRIOR ART
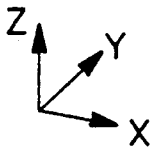

PYROLYTIC FURNACE FOR THE THERMAL CRACKING OF HYDROCARBONS

FIELD OF THE INVENTION

The invention relates to a pyrolytic furnace for the thermal cracking of hydrocarbons, comprising a radiation zone including burners and cracking tubes, the cracking tubes in the radiation zone consisting of parallel, vertically extending linear tube sections joined to one another by tube elbows located in the bottom region of the radiation zone. At least four cracking tubes are combined into groups uniformly arranged in the radiation zone, each group of cracking tubes being united in an outlet tube via manifold tube sections wherein the linear tube sections and the manifold tube sections of the individual groups are arranged in one row in the transverse direction of the pyrolytic furnace.

BACKGROUND OF THE INVENTION

Thermal cleavage (cracking) of hydrocarbons is usually carried out in pyrolytic furnaces. A conventional pyrolytic furnace includes a radiation zone heated with burners. Thermal cracking of the hydrocarbons is performed in cracking tubes in the radiation zone. Cracking of the hydrocarbons can be facilitated by preheating the hydrocarbons in a convection zone of the pyrolytic furnace before they are introduced into the radiation zone.

Among the large number of prior art pyrolytic furnaces, the foregoing has proven itself especially well. FIG. 1 illustrates a prior art arrangement of the cracking tubes in the radiation zone of one such pyrolytic furnace. In the version shown, sixteen cracking tubes are combined into groups A, B, and C. The regions of the individual groups are indicated by dot-dash lines. The hydrocarbons to be cracked are conducted in the direction of the arrows from the top into the cracking tubes in the radiation zone. The cracking tubes extend parallel and linearly (Z direction) to the bottom region of the radiation zone, where two cracking tubes are united via a collective tube section. Tube elbows adjoin the resultant eight cracking tubes of the group. From the tube elbows, straight tube sections parallel, vertically arranged (Z direction) lead to the upper region of the radiation zone. At that location, respectively, four tube sections are combined in collective tube sections into two cracking tubes. These two cracking tubes are united in a further manifold tube section to the outlet tube of the respective group. The cracked hydrocarbons are conducted out of the radiation zone of the pyrolytic furnace through the three outlet tubes of the groups. The linear tube sections and the collecting tube sections of the individual groups are arranged in one row. They all lie in the same plane (X/Z plane). Only the tube elbows in the bottom region of the radiation zone exhibit projections and jut out of this plane.

The cracking tubes are customarily suspended in the radiation zone of the pyrolytic furnace. Longitudinal expansions caused by temperature variations require a suspending of the cracking tubes. However, the mechanical stress on the cracking tubes due to their inherent weight is considerable in this case. For this reason, stress overloads occur especially in the tube elbows, particularly at high temperatures.

SUMMARY OF THE INVENTION

Therefore, an object of the invention is to provide a pyrolytic furnace of the type discussed above which prevents, in a simple way, stress overload in the cracking tubes.

Upon further study of the specification and appended claims, further objects and advantages of this invention will become apparent to those skilled in the art.

This object has been attained according to the invention by providing that at the entrance into the radiation zone, the tube sections of one group are arranged, respectively, with one half on the right side and on the left side around the outlet tube of the group, and the tube elbows of one half of the group are mounted pointing in the opposite direction to that the of the tube elbows of the second half of the group.

The arrangement of the cracking tubes in the pyrolytic furnace according to the invention has the result that the linear tube sections of the two halves of a group, traversed from the top toward the bottom, surround the tube sections laterally in the mounting plane of the cracking tubes in the radiation zone. In the pyrolytic furnace according to this invention, the radius of curvature of the tube elbows is considerably reduced, whereby stress loads are substantially diminished. Also, in the pyrolytic furnace of the invention, the juts of the tube elbows are less, i.e., the tube elbows jut out to an essentially smaller extent from the mounting plane of the cracking tubes. This likewise results in a reduction of the stress loads on the cracking tubes. In the pyrolytic furnace of this invention, the heat distribution to the cracking tubes of the individual groups is more uniform.

In another development of the invention, the cracking tubes are arranged in a stepwise staggered pattern, prior to entrance into the radiation zone, and a cracked gas cooler is located above each outlet tube of a group outside of the radiation zone in linear extension of the outlet tubes. The cracking tubes are extended, in this arrangement, in a step (two 90° curvatures) about the cracked gas coolers prior to entering the radiation zone. Consequently, an especially advantageous vertical arrangement of the cracked gas coolers is made possible.

In an especially advantageous aspect, the cracking tubes are combined, via manifold tube sections, respectively into a cracking tube having a comparatively enlarged diameter. Thereby, the pressure loss in the cracking tubes is kept small.

BRIEF DESCRIPTION OF THE DRAWINGS

Various other objects, features, and attendant advantages of the present invention will be more fully appreciated as the same becomes better understood when considered in conjunction with the accompanying drawings in which like reference characters designate the same or similar parts throughout the several views, and wherein:

FIG. 1 is a schematic view showing an array of cracking tubes in a pyrolytic furnace in accordance with prior art practices.

DETAILED DESCRIPTION

Figure 2:
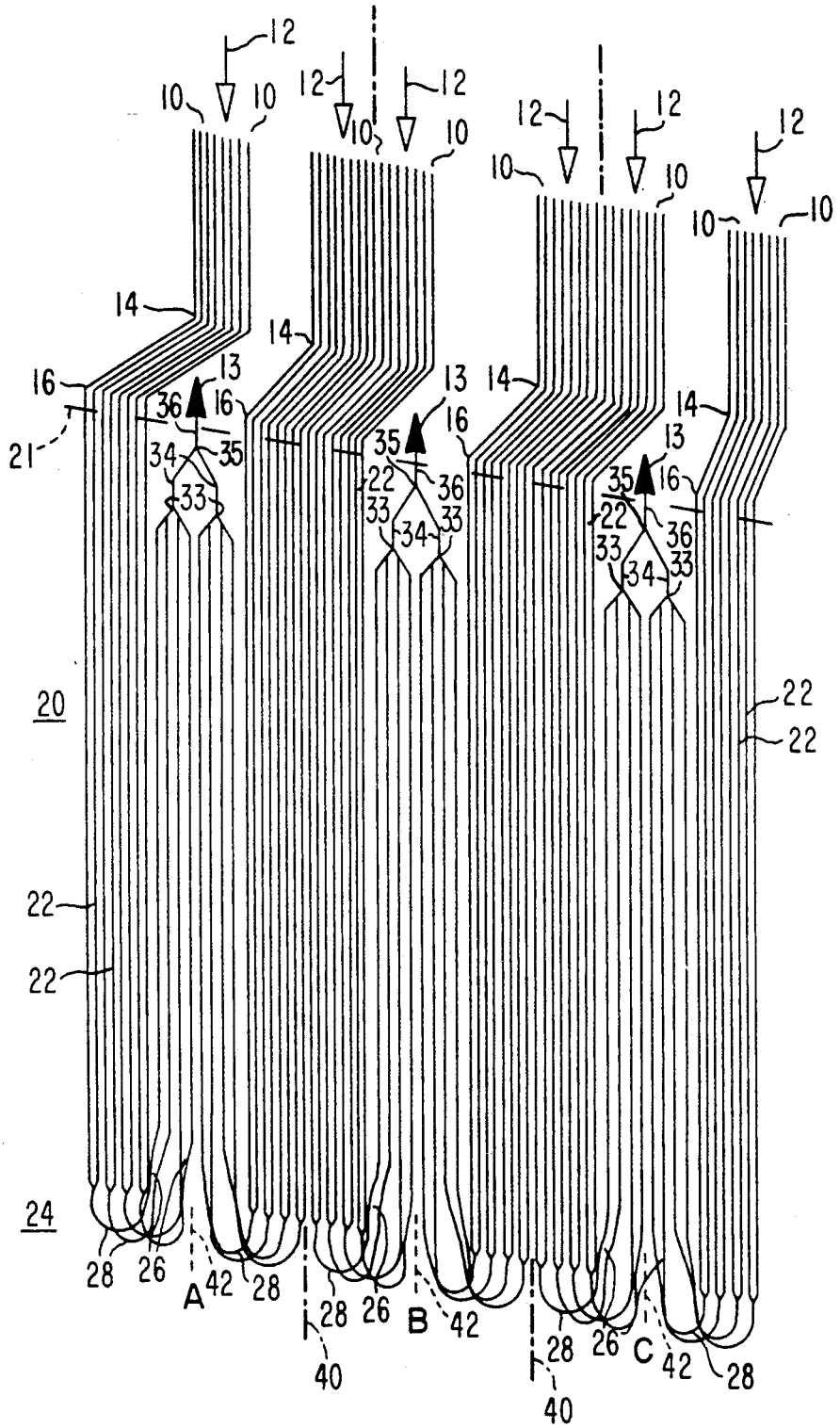
FIG. 2 is a schematic view showing an array of cracking tubes in a pyrolytic furnace configured in accordance with the instant invention.

FIG. 2 illustrates a cracking tube arrangement of a pyrolytic furnace according to the invention, which is a modification of the conventional, prior art cracking tube arrangement of FIG. 1. FIG. 2 shows three arrays A, B, and C of the cracking tubes 10, each array including sixteen tubes. The hydrocarbons to be cracked are introduced in correspondence with the direction of the arrows 12 from above into the tubes 10. The three arrays A, B, and C of the cracking tubes 10 are staggered stepwise (two 90° curvatures 14 and 16) about three cracked gas coolers (not shown) before the tubes enter into the radiation zone 20 of the pyrolytic furnace. The cracked gas coolers (not shown) are located in extensions 13 of the three outlet tubes (arrows pointing in the Z direction). The dashed line symbolizes the top end of the radiation zone 20 of the pyrolytic furnace.

Linear, vertically arranged (Z direction) first cracking tube sections 22 extend to the bottom region 24 of the radiation zone 20. In the bottom region 24, respectively, two first cracking tube sections 22 are united into one second cracking tube section 26 via a manifold tube section 28. The resultant eight cracking tubes 10 per array A, B, or C pass over into the eight cracking elbows 28, of which, respectively, four elbows 28' exhibit an approximately identical direction of curvature. A certain deviation in the curvature direction is due to the projections of the tube elbows. The arrangement of the tube elbows 28 makes it possible for the eight straight first tube sections 22 of each array A, B, or C, traversed from the bottom toward the top, into which the tube elbows terminate, to lie in the mounting plane of the cracking tubes between the straight tube sections traversed from the top toward the bottom. The second tube sections 26 lie in the mounting plane of the first cracking tube sections 22 (X/Z plane). The four straight second tube sections 26 of each array A, B, and C, traversed from the bottom 24 toward the top 21 of the pyrolytic furnace are first united via manifold tube sections 33 into two cracking tubes 34 and via a further manifold tube section 35 into a single outlet tube 36. The cracked gas coolers (now shown) are located above the outlet tubes 36 in linear extension of the outlet tubes.

In further explanation, the arrays A, B, and C have left- and right-hand first groups separated by the dotted lines 40. The second cracking tubes 26 are divided into left- and right-hand second groups by dotted lines 42.

Considering each of the arrays A,B, and C separately, as one observers from left to right in FIG. 2, the left hand first group of cracking tubes 22 is connected to the left hand second group of tubes 26 and the right hand first group of cracking tubes 22 is connected to the right hand second group of tubes 26.

Without further elaboration, it is believed that one skilled in the art can, using the preceding description, utilize the present invention to its fullest extent. From the foregoing description, one skilled in the art can easily ascertain the essential characteristics of this invention and, without departing from the spirit and scope thereof, can make various changes and modifications of the invention to adapt it to various usages and conditions.

The entire disclosure of all applications, patents, and publications, cited herein, and of corresponding German Application P 41 28 521.2 are hereby incorporated by reference.

What is claimed is:

1. In a pyrolytic furnace for thermal cracking of hydrocarbons having means defining a radiation zone having upper and lower ends in a pyrolytic furnace vessel, and an arrangement of cracking tubes, wherein the improvement comprises said arrangement of cracking tubes being formed by arrays of first cracking tube sections extending vertically into a pyrolytic furnace vessel with inlets above the upper end of the radiation zone, the arrays of first cracking tube sections being arranged in left- and right-hand first groups;

outlet tubes being disposed proximate the upper end of the pyrolytic furnace vessel between the left- and right-hand groups of first cracking tubes;

second cracking tube sections extending vertically between the right- and left-hand first groups of first cracking tube sections, the second cracking tube sections being arranged in left- and right-hand second groups, there being one-half the number of second cracking tubes as first cracking tubes;

first manifolds at the bottom of the radiation zone, each manifold connecting the left-hand first groups of the first cracking tube section to the left-hand second groups of the second cracking tube sections and connecting the right-hand first group of the first cracking tube sections to the right-hand second group of the second cracking tube sections; and second manifolds connecting each second group of second cracking tube sections to one of the outlet tubes.

2. The arrangement of claim 1, wherein the arrays of first cracking tube sections each includes a first portion disposed above the radiation zone in which the first cracking tubes extend horizontally, and a second portion above the radiation zone in which the first cracking tube sections extend vertically from the horizontal section to the inlets, whereby the first portions provide a site for a cracked gas cooler connected to the outlet tubes.

3. The arrangement of claim 2, wherein each second cracking tube section has a diameter larger than that of a first cracking tube section.

4. The arrangement of claim 1, wherein each second cracking tube section has a diameter larger than that of a first cracking tube section.

5. The arrangement of claim 1, wherein there are eight tubes comprising the first cracking tube groups and four tubes comprising the second cracking tube groups.

* * * * *